United States Patent [19]

Cargill

[11] 4,173,068

[45] Nov. 6, 1979

[54] BOLSTER-ACTUATED LOCKBACK KNIFE

[76] Inventor: Bobby L. Cargill, 14401 136th Ave., Lockport, Ill. 60441

[21] Appl. No.: 907,947

[22] Filed: May 22, 1978

[51] Int. Cl.[2] ..... B26B 1/04

[52] U.S. Cl. ..... 30/161

[58] Field of Search ..... 30/160, 161

[56] References Cited

U.S. PATENT DOCUMENTS

| | | | |
|---|---|---|---|
| 1,169,000 | 1/1916 | Brown | 30/161 |
| 3,568,315 | 3/1971 | Smith | 30/161 |
| 4,040,181 | 8/1977 | Johnson | 30/161 |
| 4,099,327 | 1/1978 | Pesa | 30/161 |

*Primary Examiner*—Jimmy C. Peters

[57] ABSTRACT

A bolster-actuated lockback knife having a handle formed with a knife blade receiving recess defined in part by a pair of spaced handle sides including a pair of spaced bolsters. One of the bolsters is an unlocking bolster identified with serrations and the other is a fixed bolster. The knife blade is pivoted between the sides adjacent a first end of the handle at which the bolsters are disposed. An elongated metallic main spring is disposed between the sides to form a bottom for the blade receiving recess, and the spring is anchored or restrained to the end of the handle opposite the first end. A first locking lug is formed on the main spring opposite the anchored end, and a second locking lug is formed on the pivoted end of the knife blade. The unlocking bolster is fixed to the free end of the main spring opposite the anchored or restrained end of the main spring. When manually operated, the unlocking bolster pivots the main spring about its handle anchor or restraint to disengage the two locking lugs to enable the knife blade to be returned to a closed position within the recess.

5 Claims, 10 Drawing Figures

BOLSTER-ACTUATED LOCKBACK KNIFE

BACKGROUND OF THE INVENTION

This invention relates to folding knives, and in particular to a bolster-actuated lockback knife. A knife in this category employs means for locking one or more blades in an extended position for improved safety.

Foldable lockback knives have been used for many years and many designs have been proposed for accomplishing positive locking and ease of locking and unlocking. Some of these designs are generally satisfactory when the knives are new or have been kept clean. However, others have various sharp edges which catch on clothing or may cut the hands in use, and many do not have a neat uncluttered appearance such as that of a conventional non-locking pocket knife.

A principal defect or disadvantage of many prior art designs is that the operating parts of the locking mechanisms are exposed. Such knives are used primarily by campers, hunters and fishermen, and sand, wood chips, and other debris quickly work in between the parts, including the spring components, and interfere with proper operation. The gaps are frequently small and inaccessible so that it is extremely difficult to clean them.

The exposed parts in many designs project from the knife handle, and thus are susceptible to false operation occasioned by even routine manual handling.

Prior art patents disclosing knife locks are as follows: U.S. Pat. Nos. 292,473, 690,927, 801,970, 866,431, 915,269, 988,068, 1,030,058, 1,169,000, 1,262,390, 1,264,625, 1,265,723, 1,451,607, 1,498,517, 2,596,294, 2,896,576, 3,942,249 and 4,040,181.

SUMMARY OF THE INVENTION

The bolster-actuated knife of the present invention is described in detail in the Abstract.

The design employing a bolster-actuated main spring to effect unlocking results in an exterior knife appearance which to the casual observer is essentially the same as that of a conventional folding pocket knife having bolsters. A plurality of identifying marks, such as serrations, distinguish the bolster which effects unlocking. Without such an identification, a user would have difficulty in determining, and perhaps even remembering, that one of the bolsters serves an otherwise indiscernible function of effecting unlocking.

Since the unlocking bolster is conventional in external design, there are no unsafe projections and no detracting unlocking mechanisms supported by the knife handle.

DESCRIPTION OF THE DRAWINGS

In order that all of the structural features for attaining the objects of this invention may be readily understood, reference is herein made to the accompanying drawings wherein.

DESCRIPTION OF THE PREFERRED EMBODIMENT

Figure 1:
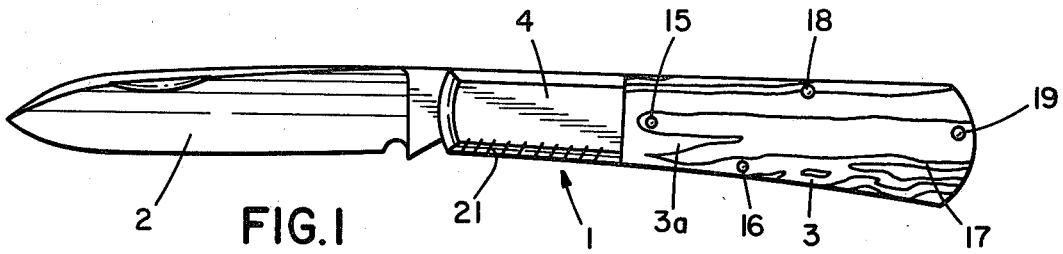
FIG. 1 is a side elevation view of a lockback knife incorporating the bolster-actuated knife lock of this invention.
Figure 2:
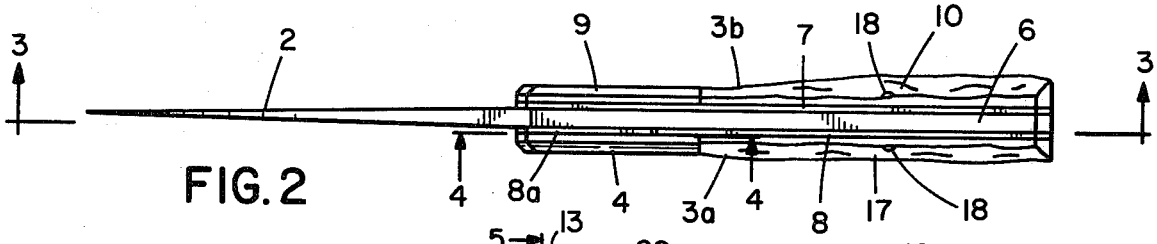
FIG. 2 is a top view of the knife of FIG. 1.
Figure 7:
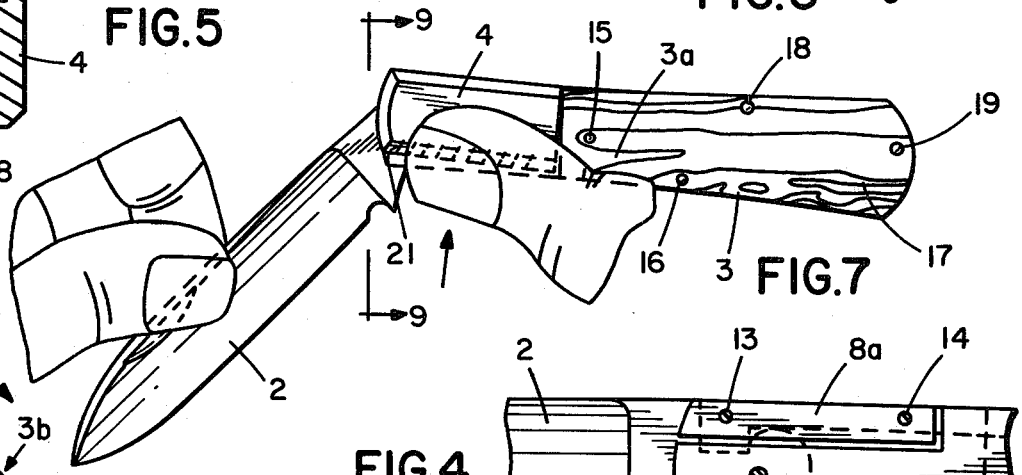
FIG. 7 is a side elevation view with the unlocking bolster being manually depressed with the knife blade being closed after an unlocking operation.

Referring to the drawings, lockback knife 1 comprises a spring steel blade 2 pivoted for opening and closing movement relative handle 3. The knife lock of this invention locks blade 1 in the open position shown in FIGS. 1 through 3. A principal novel feature resides in the structure by which manual pushing or depression of serrated unlocking bolster 4 relative the remaining portion of the handle 3 effects the unlocking of blade 2 as shown in FIG. 7. Unlocking bolster 4 has no visible structural features that would indicate to a casual observer its unlocking function.

Figure 8:
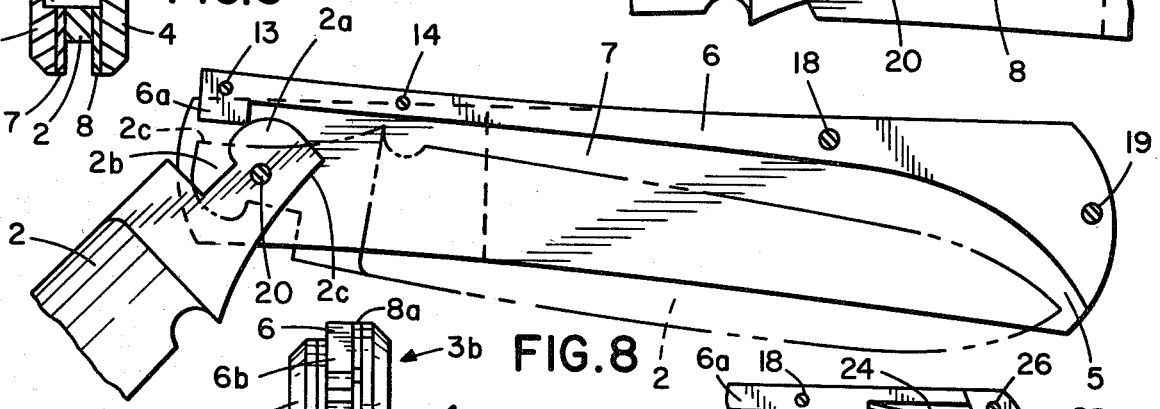
FIG. 8 is a view related to that of FIG. 7 which shows the disposition of the unlocking lugs and the camming away of the main spring during the unlocking operation.

After unlocking, blade 2 is contained within blade receiving recess 5, as is shown in broken line in FIG. 8. Blade receiving recess 5 is defined by a pair of handle sides **3*a* and 3*b* and an elongated metallic main spring 6** disposed between the handle sides to form a bottom for the blade receiving recess.

Figure 3:
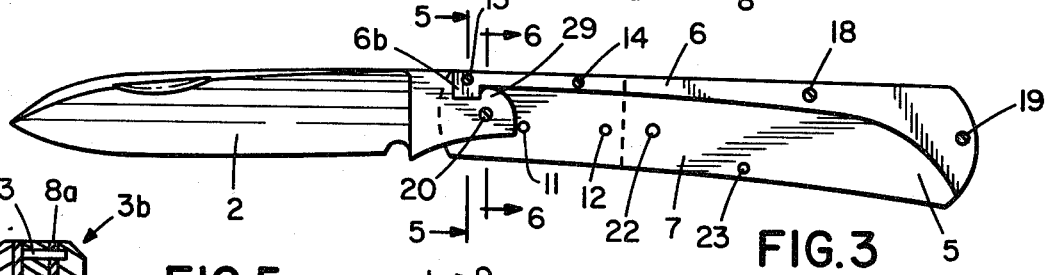
FIG. 3 is a section view taken along line 3—3 of FIG. 2 which shows the internal locking mechanism with the knife blade in the lockback position.

Handle 3 includes a pair of metal liners 7 and 8, each forming a part of handle sides **3*a* and 3*b*, respectively. In particular, liner 7 is shown in FIGS. 3 and 7. This liner forms a recess wall and it supports fixed metallic bolster 9 and ornamental bone or metallic handle grip 10. Short pins 11 and 12 fix bolster 9 (FIG. 3) to liner 7, and short pins 22 and 23 fix handle grip 10 (FIG. 3) to liner 7**.

Figure 5:
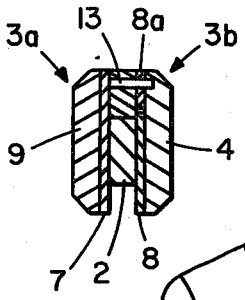
FIG. 5 is a section view taken along line 5—5 of FIG. 3 which shows one of the unlocking bolster pins which fixes the hook end of the main spring and the unlocking bolster together.
Figure 4:
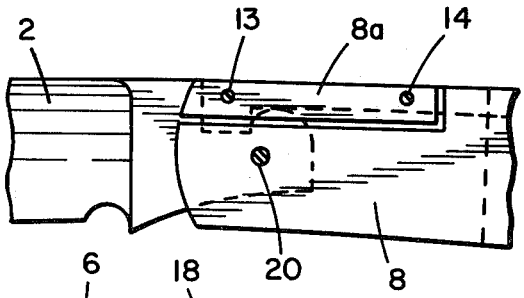
FIG. 4 is a section view taken along line 4—4 of FIG. 2 which shows the unlocking bolster liner segment and the adjacent notched liner for the knife recess.

Liner 8 is notched at its blade end as is shown in FIG. 4, and unlocking bolster liner segment **8*a* is disposed within the notch. Unlocking bolster 4 liner segment 8*a* are fixed to the left end of main spring 6 by short pins 13 and 14 (FIGS. 3, 4 and 5). Liner 8 is separated from bolster liner segment 8*a* as is shown in FIG. 8. Short pins 15 and 16 fix handle grip 17 to liner 8**.

Figure 9:
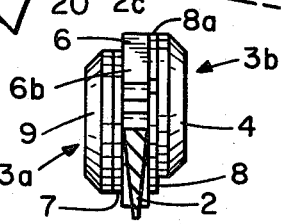
FIG. 9 is a view taken along line 9—9 of FIG. 7 which shows the pivoting of the main spring during the unlocking operation.

Handle 3, including both handle sides **3*a* and 3*b* are held together by anchor-pivot pins 18 and 19. These are the only full or through pins in the entire knife assembly, and they serve to anchor the right end of main spring 12 to handle 3, whereas the left end is cantilevered and is free to pivot about pivot pins 18 and 19. The only portion of handle 3 free to move with the left end of main spring 6 is unlocking bolster 4 and bolster liner segment 8*a*. The flexing movement of the left end of main spring 12 during unlocking of blade 2 is shown in FIGS. 7, 8 and 9**.

Figure 6:
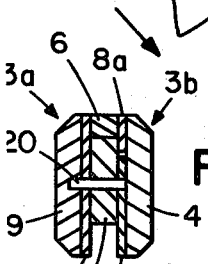
FIG. 6 is a section view taken along line 6—6 of FIG. 3 which shows the knife blade pivot pin.

Blade 2 is pivotally supported relative handle 3 by pivot pin 20 (FIGS. 3, 6 and 8). As is best shown in FIG. 6, pin 20 extends between and is supported by metal liners 7 and 8.

Locking lugs 2*a* and 6*a* are formed on the pivoted right end of blade 2 and free of cantilevered end of main spring 6, respectively. Locking lug 2*a* is preferably formed with rounded corners in view of the fact that lug 2*a* performs a camming operation upon the square corners of lug 6*a* during the locking and unlocking operations. A locking notch or recess 2*b* (FIG. 8) is formed on blade 2 immediately adjacent lug 2*a*. During the locking operation, locking lug 6*b* is engaged within notch 2*b* to lock blade 2 in the open position.

The operation of knife during a blade 2 opening and locking operation is as follows:

Blade 2 and handle 3 are each manually engaged without regard to or operation of either bolster 4 or 9. As blade 2 is manually opened, the back edge 2*c* of locking lug 2*b* will engage locking lug 6*a* and cam, or otherwise drive, the left or cantilevered end of main spring 12 upwardly (FIG. 8). This motion of main spring 12 also moves unlocking bolster 4 upwardly. Ultimately, when blade 4 is opened fully (FIG. 5), locking lugs 2*a* and 6*a* engage, with lug 6*b* being locked within notch 2*b*. With this occurrence, the left end of main spring 6 falls back into place relative handle 2. Blade 2 is thus locked open.

To effect unlocking of blade 2, unlocking bolster 4 is manually moved (preferably by thumb) upwardly (FIG. 7) relative the remaining portions of handle 2. The movement of unlocking bolster 4, also elevates the left end of main spring 6 (FIG. 9), thereby sufficiently disengaging the two locking lugs 2*a* and 6*a*. Thereafter, a manual closing movement of blade 2 (FIG. 7) can be effected until blade 2 is housed within recess 5 of handle 2.

Unlocking bolster 4 is formed with a plurality of serrations 21 which distinguish bolster 4 from fixed bolster 9. Serrations 21 are applied to bolster 4 to serve as an identification of the unlocking function served by only this bolster.

It is not necessary to anchor rigidly main spring 6 on handle 3. Unlocking bolster 4 will operate generally in the above-described manner if the right end of spring 6 is merely restrained as shown in FIG. 10.

Figure 10:
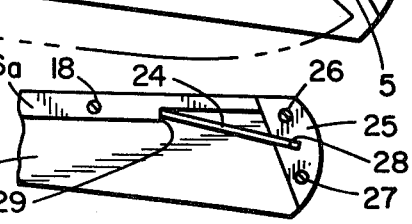
FIG. 10 is a fragmentary view which shows a second embodiment for retaining the main spring on the knife handle.

In FIG. 10, alternative main spring 6*a* is pivoted on anchor pin 18. Pin 19 of FIG. 8 is eliminated. A metal butt 25 is fixed to handle 3 by butt pins 26 and 27. A wire spring 24 extends between spring retaining hole 28 and notch 29. Accordingly, the movement of bolster 4 upwardly, as shown in FIG. 7, causes main spring 6*a* (FIG. 10) to pivot about pin 18. Main spring 6*a* is restrained with some slight movement by the flexing action of wire spring 24. Accordingly, the right end of main spring 6*a* is permitted to yield minutely in the embodiment of FIG. 10.

It should be understood that the above-described preferred embodiments are merely illustrative of the principles of this invention and that modifications can be made without departing from the scope of the invention. For example, a double unlocking bolster could be employed in a two-blade knife.

What is claimed is:

1. In a lockback knife having a handle formed with a knife blade receiving recess defined in part by a pair of spaced handle sides including a bolster with the knife blade being pivoted between the sides adjacent a first end of the handle at which the bolster is disposed, the improvement comprising an elongated metallic main spring disposed between the sides to form at least a part of a bottom for the blade receiving recess and with the spring being restrained generally on the end of the handle opposite the first end, first locking means being formed on the main spring opposite the restrained end and second locking means being formed on the pivoted end of the knife blade with the two locking means engaging one another to lock the knife open, and the bolster being fixed to the free end of the main spring opposite the restrained end and the bolster when manually operated pivoting the main spring about its handle restraint to disengage the two locking means to enable the knife blade to be returned to a closed position within the recess.

2. The combination of claim 1 in which the pair of spaced handle sides includes a pair of spaced bolsters with the second bolster being fixed to the handle to move with the handle and independent of the free end of the main spring.

3. The combination of claim 1 in which the handle includes a metal butt, and in which a wire spring extends between the main spring and the butt to restrain the main spring.

4. The combination of claim 2 in which each spaced handle side includes a metallic liner defining with the main spring the blade receiving recess with the unlocking bolster being supported for relative movement with respect to both liners, and with the other bolster being fixed to move with both liners.

5. The combination of claim 4 in which both means are locking lugs which engage one another to effect locking.

* * * * *